US005232132A

United States Patent [19]

Broussard et al.

[11] Patent Number: 5,232,132

[45] Date of Patent: Aug. 3, 1993

[54] RIBBON STRIP AND CURL APPARATUS

[76] Inventors: Hermae A. Broussard, 735 Hillside, Vidor, Tex. 77662; Teddy L. Broussard, 9270 Cumberland, Beaumont, Tex. 77708

[21] Appl. No.: 835,517

[22] Filed: Feb. 14, 1992

[51] Int. Cl.[5] ..... A41M 43/00; D02G 3/24; B26B 3/00

[52] U.S. Cl. ..... 223/44; 223/46; 28/260; 30/299; 30/355

[58] Field of Search ..... 28/260, 261, 262; 223/44, 46; 30/299, 355, 231, 244, 248, 303; 7/118

[56] References Cited

U.S. PATENT DOCUMENTS

| | | | |
|---|---|---|---|
| 756,818 | 4/1904 | Benton | 30/355 |
| 812,325 | 2/1906 | Brower | 30/299 |
| 858,531 | 7/1907 | Palmer | 30/355 |
| 908,368 | 12/1908 | Williams | 30/355 |
| 1,992,517 | 2/1935 | Watson | 30/299 |
| 1,994,215 | 3/1935 | Gaunt | 30/299 |
| 4,014,093 | 3/1977 | Keiser, Jr. | 30/248 |
| 4,661,197 | 4/1987 | Mancel et al. | 223/46 X |

*Primary Examiner*—Clifford D. Crowder
*Assistant Examiner*—Bibhu Mohanty
*Attorney, Agent, or Firm*—Leon Gilden

[57] ABSTRACT

A handle member mounts a first blade member therewithin, with the first blade member including a forward shank portion to include a serrated blade edge spaced from and parallel a rear blade edge. A pivotally mounted stripper blade is in contiguous and pivotal relationship relative to a top surface of the first blade member to capture a ribbon web therebetween from a ribbon spool to effect stripping of the web from the spool simultaneously, with effecting a curling of the web directed between the stripper blade and the serrated blade edge.

5 Claims, 4 Drawing Sheets

RIBBON STRIP AND CURL APPARATUS

BACKGROUND OF THE INVENTION

1. Field of the Invention

The field of invention relates to ribbon apparatus, and more particularly pertains to a new and improved ribbon strip and curl apparatus wherein the same is arranged to simultaneously strip and curl a ribbon relative to a spool for use in adornment of packages and the like.

2. Description of the Prior Art

The removal of ribbon from a spool and its subsequent curling by individuals for use as adornments such as in floral bouquets, packaging, and the like is a time-consuming process frequently requiring a plurality of tools to effect the initial removing of the ribbon from associated spool and its subsequent curling at a free distal end of the ribbon as used in the creation of ribbon bows and the like. The U.S. Pat. No. 4,910,051 to Pickering, et al. sets forth a ribbon bow formed with curled edges thereof.

U.S. Pat. No. 4,826,712 to Theno sets forth decorative gift wrapping ribbons as examples in the prior art.

U.S. Pat. No. 4,822,648 to Cheng sets forth a decorative bow and its method of creation utilizing press structure.

The U.S. Pat. No. 4,724,178 to Labrosse, et al. sets forth a pre-fabricated bow ribbon utilizing curled free edges.

As such, it may be appreciated that there continues to be a need for a new and improved ribbon strip and curl apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of ribbon apparatus now present in the prior art, the present invention provides a ribbon strip and curl apparatus wherein the same is arranged to simultaneously strip and curl a ribbon relative to a ribbon spool. As such, the general purpose of the present invention, which will be described subsequently in greater detail, is to provide a new and improved ribbon strip and curl apparatus which has all the advantages of the prior art ribbon apparatus and none of the disadvantages.

To attain this, the present invention provides a handle member mounting a first blade member therewithin, with the first blade member including a forward shank portion to include a serrated blade edge spaced from and parallel a rear blade edge. A pivotally mounted stripper blade is in contiguous and pivotal relationship relative to a top surface of the first blade member to capture a ribbon web therebetween from a ribbon spool to effect stripping of the web from the spool simultaneously, with effecting a curling of the web directed between the stripper blade and the serrated blade edge.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ribbon strip and curl apparatus which has all the advantages of the prior art ribbon apparatus and none of the disadvantages.

It is another object of the present invention to provide a new and improved ribbon strip and curl apparatus which may be easily and efficiently manufactured and marketed.

It is a further object of the present invention to provide a new and improved ribbon strip and curl apparatus which is of a durable and reliable construction.

An even further object of the present invention is to provide a new and improved ribbon strip and curl apparatus which is susceptible of a low cost of manufacture with regard to both materials and labor, and which accordingly is then susceptible of low prices of sale to the consuming public, thereby making such ribbon strip and curl apparatus economically available to the buying public.

Still yet another object of the present invention is to provide a new and improved ribbon strip and curl apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
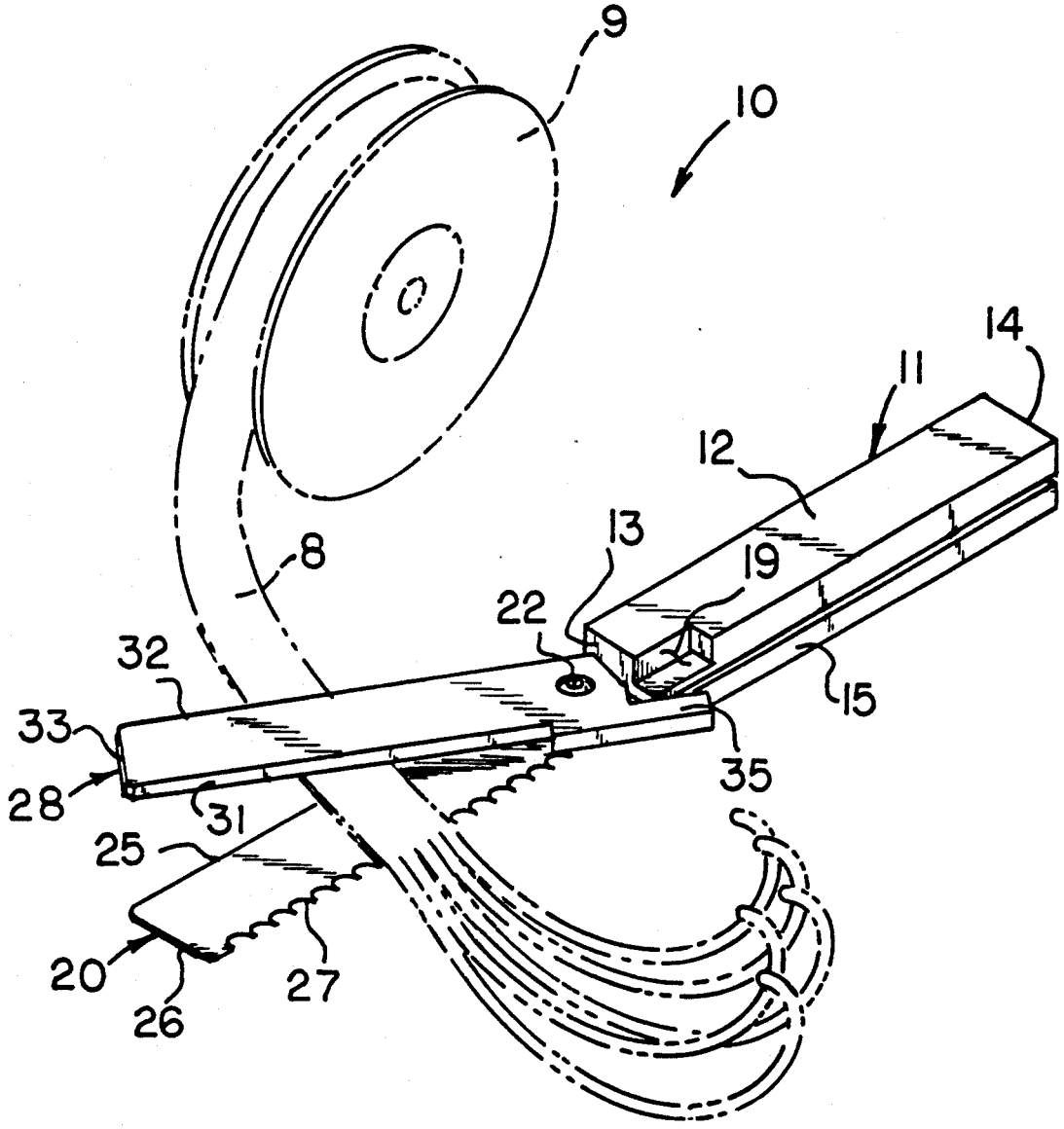
FIG. 1 is an isometric illustration of the instant invention in use.
Figure 2:
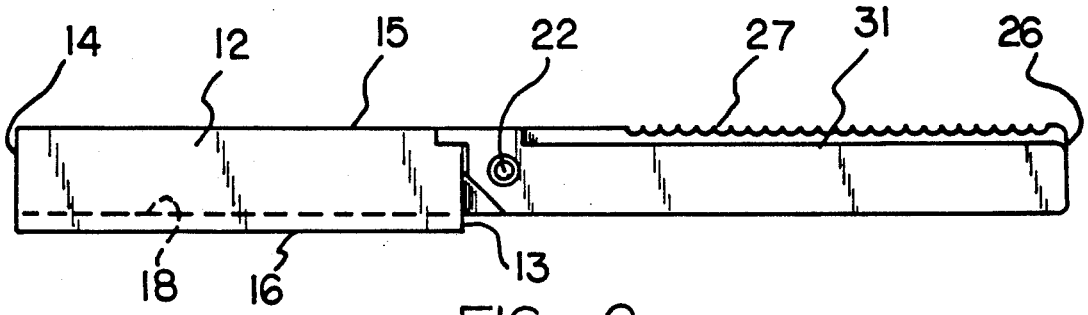
FIG. 2 is an orthographic top view of the instant invention.
Figure 3:
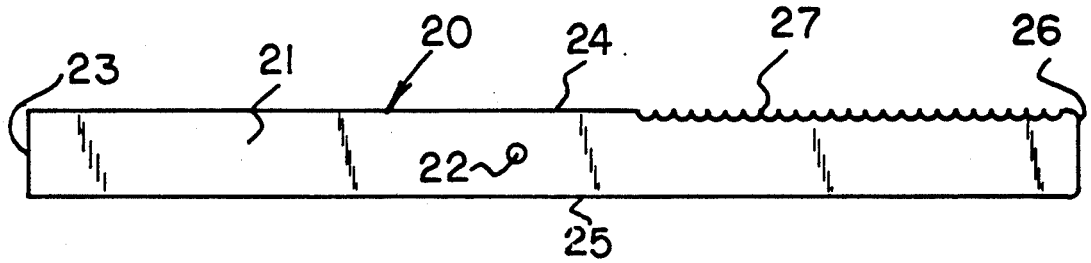
FIG. 3 is an orthographic top view of the first blade member.
Figure 4:
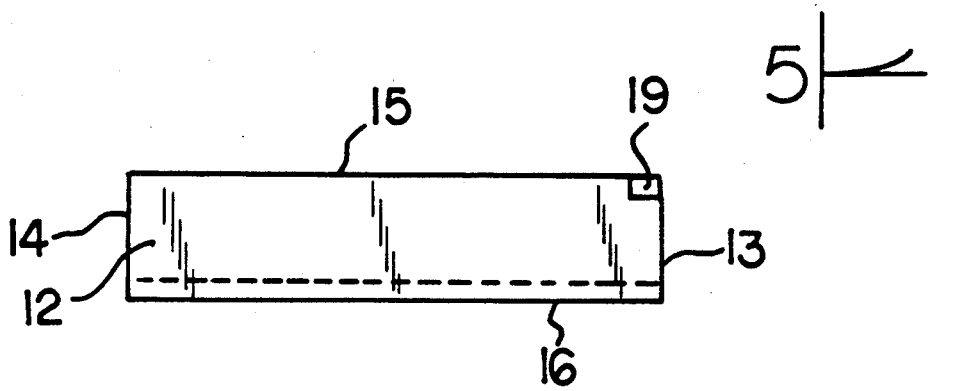
FIG. 4 is an orthographic top view of the handle member.
Figure 5:
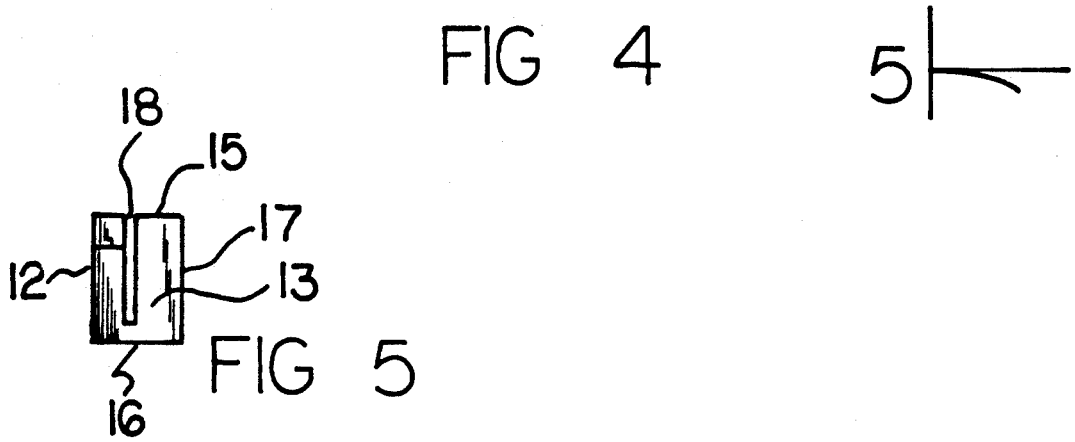
FIG. 5 is an orthographic view, taken along the lines 5—5 of FIG. 4 in the direction indicated by the arrows.
Figure 6:
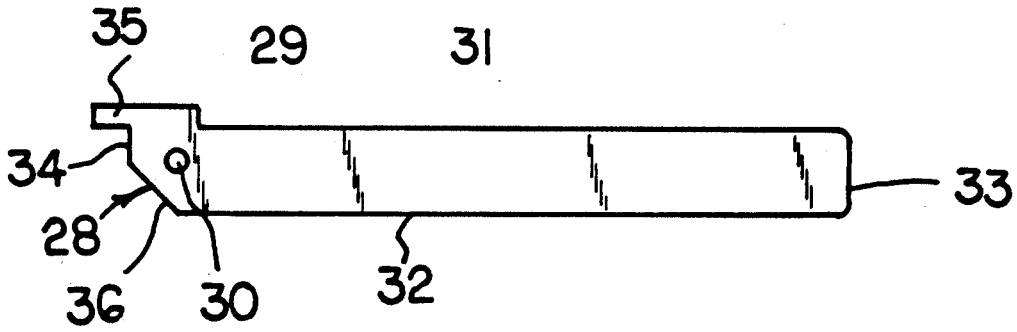
FIG. 6 is an orthographic top view of the stripper blade.

With reference now to the drawings, and in particular to FIGS. 1 to 7 thereof, a new and improved ribbon strip and curl apparatus embodying the principles and concepts of the present invention and generally designated by the reference numerals 10 and 10*a* will be described.

More specifically, the ribbon strip and curl apparatus 10 of the instant invention essentially comprises a handle member 11 formed of a rigid material to include a top wall 12 spaced from and parallel a bottom wall 17. A first end wall 13 is spaced from and parallel a second end wall 14, with a first side wall 15 spaced from and parallel a second side wall 16. The handle member 11 as illustrated is formed of a generally parallelepiped configuration. A blade receiving slot 18 is directed coextensively through the handle member 11 extending from the first end wall 13 through the second end wall 14 and oriented parallel to and medially of the top and bottom walls 12 and 17. A handle recess 19 is directed into the handle projecting through the first side wall 15 between the slot 18 and the top wall 12 and further projecting through the first end wall 13 between the slot 18 and the top wall 12 for receiving an abutment leg 35 of a stripper blade 28, as illustrated in FIG. 1, to be described in more detail below, but utilized to maintain desired alignment between the stripper blade 28 and a first blade member 20. The first blade member 20 includes a plate-like blade member shank 21 that is positioned within the slot 18 coextensive therewith and complementarily received. The shank 21 includes a shank rear edge 23 spaced from a shank forward edge 26, with an axle 22 orthogonally and fixedly mounted to a top surface of the shank 21 defining a predetermined length between the axle 22 and the forward edge 26. A first side edge 24 is spaced from and parallel a second side edge 25 in a parallel relationship defining a first predetermined width therebetween, wherein the first predetermined width is substantially equal to a depth of the slot 18. The first side edge 24 includes a serrated portion 27 extending between the axle 22 and the forward edge 26 for the curling of a ribbon web 8 removed from a ribbon spool 9 by stripping action for use of an associated stripper blade 28, as illustrated in FIG. 1. The stripper blade 28 includes a blade body 29 of a plate-like configuration, including an axle receiving bore 30 arranged for receiving the axle 22 therethrough, wherein the axle receiving bore is spaced from the stripper blade forward edge 33 the predetermined length. The stripper blade body 29 includes a stripper blade first side edge 31 spaced from and parallel a stripper blade second side edge 32 a second predetermined width less than the first predetermined width to expose the serrated portion 27 when the ribbon web 8 is directed therealong. The stripper blade 28 is pivoted to a first position in longitudinal alignment and in contiguous communication with a top surface of the first blade member 20 to guide and direct the web 8 from the spool 9 in a stripping action while an individual manually directs the ribbon web 8 along the serrated portion 27 to effect a curling of the web, in a manner as illustrated in FIG. 1. The stripper blade body 29 includes a stripper blade leg member 35 projecting rearwardly of the stripper blade rear edge 34 in an orthogonal relationship and positioned forwardly of the stripper blade first side edge 31 to be received within the handle recess 19. A recess edge 36 defining an obtuse included angle between the edge 36 and the stripper blade rear edge 34 further defines an obtuse included angle between the recess edge 36 and the stripper blade second side edge 32 to provide clearance for pivotment of the stripper blade 28 relative to the first end wall 13.

Figure 7:
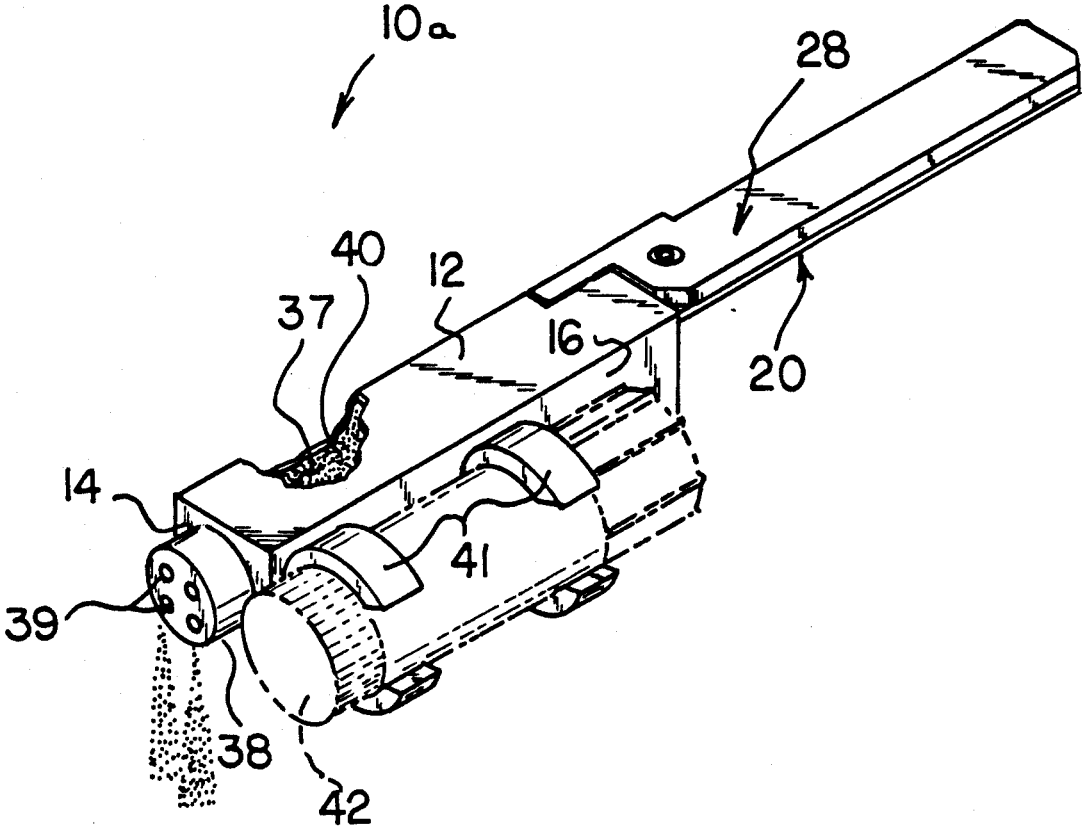
FIG. 7 is an isometric illustration of a modification of the invention.

The FIG. 7 illustrates a modified apparatus 10*a* including the handle member 11 formed as a hollow member defining a reservoir 37 therewithin filled with a reflective articulate medium 40. The cap 38 removably mounted to the second end wall 14 includes cap bores 39 directed therethrough in communication with a reservoir 37 to direct the articulate medium 40 from the reservoir 37 onto a surface of the web 8. A plurality of "C" shaped spring clips 41 mounted to the second side wall 16 of the handle member 11 secures an adhesive cylinder 42 therebetween, wherein the cylinder 42 projects beyond the second end wall 14 to direct an adhesive layer onto the web 8 followed by the particulate medium directed from the cap 38 to provide for further decoration of the web 8 for use in decorative packaging.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A ribbon strip and curl apparatus, comprising, a handle member, the handle member mounting a first blade member, and the first blade member pivotally mounting a stripper blade to the first blade member, the first blade member including a serrated edge portion, with the first blade member including a stripper blade first side edge positioned above and spaced rearwardly of the serrated edge portion to capture and direct a ribbon web between the first blade member and the stripper blade member permitting projection of the ribbon web along the serrated edge portion for curling of the ribbon web, and the handle member includes a top wall spaced from a bottom wall, a first end wall spaced from a second end wall, and a first side wall spaced from a second side wall, and a blade receiving slot directed into the first side wall spaced from the second side wall, and the slot oriented parallel between the top wall and the bottom wall and orthogonally extending through the first end wall and the second end wall, and the first blade member including a shank plate, wherein the shank plate includes a rear edge spaced from a forward edge, and an axle fixedly and orthogonally mounted to a top surface of the shank between the rear edge and the forward edge, and predetermined length defined between the axle and the forward edge, and the shank including a first side edge spaced from a second side edge, wherein the serrated edge portion extends between the axle and the forward edge along the first side edge.

2. An apparatus as set forth in claim 1 wherein the stripper blade includes a body plate, including an axle receiving bore directed orthogonally through the body plate, and the body plate including a stripper blade forward edge spaced from a stripper blade rear edge and a stripper blade first edge spaced from a strip blade second side edge, wherein the axle receiving bore is spaced from the stripper blade forward edge a length equal to the predetermined length receiving the axle therethrough, with the stripper blade in contiguous communication with the first blade member.

3. An apparatus as set forth in claim 2 wherein the stripper blade includes a stripper blade leg member projecting orthogonally and rearwardly of the stripper blade rear edge and spaced beyond the stripper blade first side edge, wherein the leg member is coplanar with the body plate, and the handle member including a handle recess projecting through the first side wall oriented between the slot and the top wall, and wherein the handle recess projects through the first end wall oriented between the slot and the top wall, and the leg member is arranged for reception complementarily within the handle recess in a first position when the stripper blade is longitudinally aligned with and positioned above the stripper blade in contiguous communication therewith, and the stripper blade is pivoted to a second position, wherein the leg member is displaced from the handle recess.

4. An apparatus as set forth in claim 3 wherein the body plate includes a recess edge extending from the stripper blade rear edge to the stripper blade second side edge and defines an obtuse included angle between the recess edge and the stripper blade rear edge, and defines a further obtuse included angle between the recess edge and the stripper blade second edge.

5. An apparatus as set forth in claim 4 wherein the handle member is hollow and defines a reservoir therewithin, and a cap member removably mounted relative to the second end wall, with the cap member including cap bores in communication with the reservoir, the reservoir including a reflective particulate medium contained therewithin permitting variation of the medium through the cap bores, and the handle member second side wall including a plurality of "C" shaped spring clips fixedly secured to the second side wall, and an adhesive cylinder mounted within the "C" shaped spring clips, wherein the adhesive cylinder projects beyond the second end wall to provide for application of and adhesive layer onto the ribbon web for subsequent adhering of the reflective particulate medium onto the ribbon web.

* * * * *